US005943995A

United States Patent [19]

Niwa et al.

[11] Patent Number: 5,943,995

[45] Date of Patent: Aug. 31, 1999

[54] FUEL INJECTION APPARATUS HAVING CYLINDER SCREW FOR MOUNTING FUEL INJECTOR ON ENGINE

[75] Inventors: Yutaka Niwa; Hiroatsu Yamada, both of Nagoya; Masanori Sugiyama, Aichi-gun; Tateki Takayama, Toyota, all of Japan

[73] Assignee: Denso Corporation, Kariya, Japan

[21] Appl. No.: 08/896,087

[22] Filed: Jul. 17, 1997

[30] Foreign Application Priority Data

| | | | |
|---|---|---|---|
| Jul. 18, 1996 | [JP] | Japan | 8-189212 |
| Jul. 18, 1996 | [JP] | Japan | 8-189213 |
| Jul. 19, 1996 | [JP] | Japan | 8-190537 |

[51] Int. Cl.[6] ..... F02M 37/04

[52] U.S. Cl. ..... 123/470; 123/468

[58] Field of Search ..... 123/470, 509, 123/472, 468, 469; 239/600

[56] References Cited

U.S. PATENT DOCUMENTS

| | | | |
|---|---|---|---|
| 1,948,557 | 2/1934 | Baur . | |
| 2,898,895 | 8/1959 | Koppel | 123/470 |
| 3,605,703 | 9/1971 | Moulds . | |
| 4,066,213 | 1/1978 | Stampe | 123/470 |
| 4,104,992 | 8/1978 | Fricker | 123/470 |
| 4,589,596 | 5/1986 | Stumpp | 123/470 |
| 4,938,193 | 7/1990 | Raufeisen | 123/470 |
| 4,984,549 | 1/1991 | Mesenich | 123/472 |
| 5,007,401 | 4/1991 | Grohn | 123/470 |
| 5,566,658 | 10/1996 | Edwards | 123/470 |
| 5,692,477 | 12/1997 | Berger | 123/470 |

FOREIGN PATENT DOCUMENTS

| | | | |
|---|---|---|---|
| 683285 | 6/1930 | France | 123/470 |
| 2136719 | 12/1972 | France . | |
| 3908796 A1 | 6/1988 | Germany . | |
| A-61-12971 | 1/1986 | Japan . | |
| B2-62-1102 | 1/1987 | Japan . | |
| A-5-33650 | 2/1993 | Japan . | |
| 188413 | 7/1937 | Switzerland . | |

*Primary Examiner*—Carl S. Miller
*Attorney, Agent, or Firm*—Nixon & Vanderhye P.C.

[57] ABSTRACT

A cylinder screw is fitted around an injector axially movably between a tapered surface and a flange. The cylinder screw presses down the flange in a direction to attach the injector to a cylinder head and presses up the tapered surface in a direction to detach the injector from the cylinder head. A stopper is formed annularly at the top of the injector and has a protrusion. With the protrusion being engaged in a positioning groove of the cylinder head, the injector is restricted from being turned in both rotating directions. Thus, the injector can be attached to and detached from the cylinder head with ease by only one cylinder screw without turning the injector. The flange of a retaining nut to which the tightening force of the cylinder screw exerts has a shortened axial length so that deformation in injector constituting members is reduced and changes in the fuel injection characteristics are reduced.

14 Claims, 5 Drawing Sheets

FUEL INJECTION APPARATUS HAVING CYLINDER SCREW FOR MOUNTING FUEL INJECTOR ON ENGINE

BACKGROUND OF THE INVENTION

1. Field of the Invention

The present invention relates to a fuel injection apparatus in which a fuel injector is mounted on an internal combustion engine through a cylinder screw.

2. Related Art

It is known to use a cylinder screw for mounting a fuel injector on a cylinder head of a direct injection type engine in which fuel is injected directly into an engine cylinder. The cylinder screw is fitted around the outer periphery of the injector. The cylinder screw is threaded into the cylinder head to press the injector to the cylinder head.

As the nozzle part of the injector faces a combustion chamber according to the injector in the above direct injection type engine, however, soot and similar substances produced in combustion are likely to accumulate between the nozzle part and the cylinder head and stick thereat. When the soot and similar substances remain sticking strongly, the injector must be shaken or pried to be detached from the cylinder head by using certain tools after unthreading the cylinder screw from the cylinder head, resulting in difficult in detaching work.

Further, it may occur that the force applied to the injector deforms members constituting the magnetic circuit of the injector or varies the biasing force of a spring, resulting in changes in injection characteristics of the injector, i.e., fuel injection timing and fuel injection quantity. Thus, it becomes impossible to reuse the injector which has been detached once.

It is also known by the publication ("DIESEL FUEL INJECTION", page 159, FIG. 4.108(C), published on Jun. 15, 1988 by SANKAIDO) to mount an injector on a cylinder head without turning the injector. This injector may be attached by holding a flange by the cylinder head and a retaining nut, and by the retaining nut or the like a fuel pipe may be attached to the injector having been attached to the cylinder head. As a large turning force is exerted on the injector at this moment, the injector must be gripped firmly by a certain tool to hold the injector in position to the turning direction for such attaching work. This will complicate the injector mounting work.

Further, as the large turning force is applied to the injector for a thread engagement between the retaining nut and the injector at the time of connecting the fuel pipe to the injector, the position of the injector is likely to be displaced in the turning direction even if the injector is held gripped by the tool.

Still further, a cylinder screw is threaded into the cylinder head until it abuts the retaining nut for pressing the injector to the cylinder head. The injector is pressed to the cylinder head at an end position of the threaded engagement part between the housing and the retaining nut which is opposite to the injector attaching direction. According to this attachment structure, the distance between the position where the retaining nut is engaged with the cylinder head and the position where the retaining nut is pressed by the cylinder screw becomes long, increasing the deformation of the retaining nut by the tightening force of the cylinder screw. The increase in the deformation of the retaining nut increases the deformation of the injector constituting members, particularly, the deformation of members located within the axial length of the retaining nut. Therefore, if this attachment structure is applied to an electromagnetically-controlled injector, the air gap between a movable core and a stationary core may be shortened, a sliding clearance of movable parts may be reduced or fixing condition between members may be weakened. The deformation in the injector will cause changes in injection quantity and injection timing of the injector, making it difficult to provide the injection characteristics as designed.

SUMMARY OF THE INVENTION

It is an object of the present invention to provide a fuel injection apparatus which enables attachment and detachment of an injector with ease in a simple construction and reuse of the injector after detachment.

It is another object of the present invention to provide a fuel injection apparatus which can be mounted in a simple attachment work.

It is a still another object of the present invention to provide a fuel injection apparatus which does not alter injection characteristics of an injector even when a twisting force is applied to the injector at the time of connecting a fuel pipe.

According to the first aspect of the present invention, a cylindrical mounting member is used to mount or attach an injector to an engine. The injector has two engagement parts at which the mounting member abuts. The mounting member not only presses a first engagement part in a direction of attachment of the injector to a cylinder head but also presses a second engagement part in a direction opposite to the injector mounting direction. This enables detachment of the injector from the cylinder head with ease by only loosening a thread engagement between the mounting member and the engine, turning the mounting member further until its abutment with the second engagement part and finally turning the mounting member and the injector integrally, even when soot and similar substances remain sticking strongly between the injector and the cylinder head. Further, as the force applied to the injector at the time of detaching the injector from the cylinder head exerts in the axial direction of the injector, the injector and the cylinder head will be damaged less. The injector is therefore reusable after detachment because the injector maintains its injection characteristics.

Preferably, the first engagement part and the second engagement part of the injector are provided to reside in the cylinder head under the condition the injector is attached to the cylinder head. As the distance between the soot-sticking part and the second engagement part becomes short, the deformation of the injector will be reduced even when the injector is detached with its second engagement part being pressed with a large force under the circumstance that the soot and the similar substances attach between the injector and the cylinder head strongly. As a result, there will occur in the injector no substantial deformation of magnetic circuit constituting members nor substantial change in biasing force of a spring. This makes it possible to maintain the injection characteristics of the injector and to reuse the same.

According to the second aspect of the present invention, an injector has a rotation restricting member. The rotation restricting member is engaged with a cylinder head at the time of attaching the injector to the cylinder head or connecting a fuel pipe to the injector. This restricts the injector from turning in a rotating direction to simplify mounting work. As the rotational position of the injector is thus maintained, the fuel injection direction of the injector can be set as designed.

Preferably, a thread tightening force of a connecting member applied at the time of connecting a fuel pipe is restricted from exerting on a side of the injector opposite to the connecting member. Thus, injector constituting members at the side opposite to the connecting member will not be deformed by the tightening force of the connecting member.

Preferably, a twisting force is applied only between the rotation restricting member and a part which is thread-engaged with the connecting member at the time of connecting the fuel pipe. Thus, as the magnetic circuit constituting members and injection quantity metering members of the injector will not be deformed, the injection characteristics of the injector will not be altered.

According to the third aspect of the present invention, an injector has a connecting member or a retaining nut which connects a nozzle body and a housing. A cylindrical mounting member abuts the connecting member at the lowermost part of a thread engagement part between the connecting member and the housing. A pressing member presses the mounting member to a cylinder head. This shortens the axial length of the injector held between the cylinder head and the mounting member and reduces deformation of injector constituting members at the time of attaching the injector to the cylinder head. Thus, the air gap between a movable core and a stationary core will be restricted from being shortened and the sliding clearance of a movable member will be restricted from being reduced, keeping the injection characteristics of the injector.

BRIEF DESCRIPTION OF THE DRAWINGS

Other objects, features and advantages of the present invention will be made more apparent from the following detailed description with reference to the accompanying drawings, in which.

DETAILED DESCRIPTION OF THE PRESENTLY PREFERRED EMBODIMENT

Figure 1:
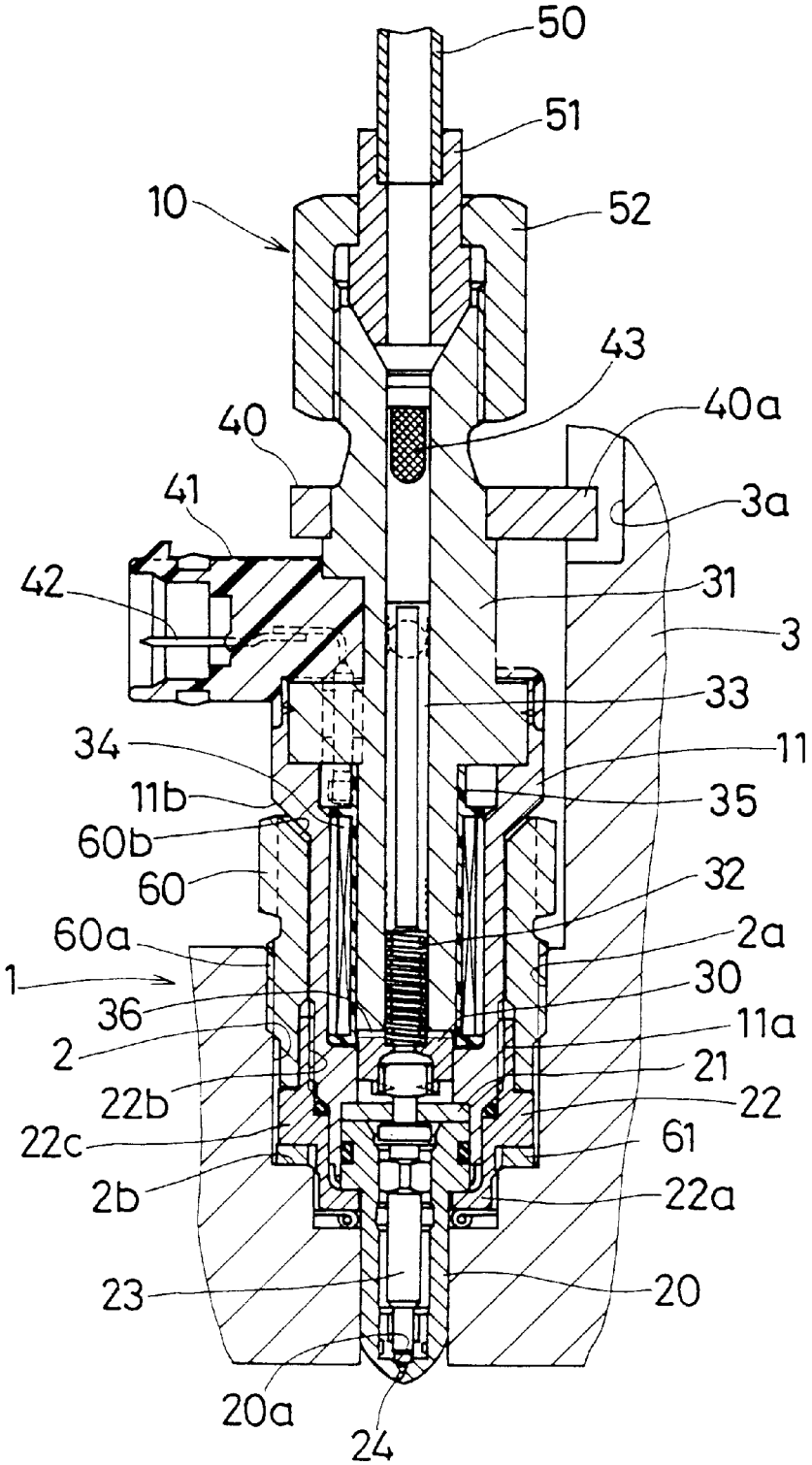
FIG. 1 is a longitudinal sectional view of a fuel injection apparatus according to the first embodiment of the present invention.

The present invention will be described in detail with reference to various embodiments in which the same or similar reference numerals are used to denote the same or similar parts throughout the embodiments.

First Embodiment

As shown in FIG. 1, an electromagnetically controlled fuel injector 10 of a fuel injection apparatus is mounted on a cylinder head 1 of an engine to directly inject fuel into a combustion chamber of each cylinder. The injector 10 is placed in position by a stopper 40 with respect to its rotating or circumferential direction. The injector 10 is attached by fitting into a mounting hole 2 of the cylinder head 1 by threading a cylinder screw 60 which functions as a cylindrical mounting member into the cylinder head 1.

A housing 11 and a nozzle body 20 of the injector 10 are coupled to each other by a retaining nut 22 with a spacer 21 being sandwiched therebetween. The retaining nut 22 is ark formed with a reduced diameter part 22*a* at its lowermost end at the side of an injection hole 24. The reduced diameter part 22*a* is engaged with the nozzle body 20. The housing 11 and the nozzle body 20 are coupled by a thread engagement between a female thread 22*b* formed on the inner peripheral wall of the upper cylindrical wall of the retaining nut 22 and a male thread 11a formed on the outer peripheral wall of the housing 11. An annular flange 22*c* which functions as a first engagement part and protrudes radially outwardly is formed around the outer periphery of the retaining nut 22 at a position between the reduced diameter part 22*a* and the female thread 22*b*. The housing 11 is formed with a tapered surface 11*b* which functions as a second engagement part and abuts the cylinder screw 60 when the cylinder screw 60 moved upward. The tapered surface 11*b* is formed so that the outer diameter of the housing 11 reduces in the downward direction in FIG. 1, that is, as it comes closer to the side of injection hole 24 of the nozzle body 20.

A needle valve 23 is housed reciprocally movably in the nozzle body 20. Fuel is injected through the injection hole 24 formed in the bottom end of the nozzle body 20 at the time the needle valve 23 is lifted from a valve seat 23 formed on the inside wall of the nozzle body 20. The injection hole 24 is formed to have a predetermined angle relative to the longitudinal axis of the injector 10. The injection hole 24 is formed to have the predetermined angle against the longitudinal axis of the injector 10 for the purpose that fuel is stratified and combusted in the combustion chamber of an in-cylinder direct injection type engine in which fuel is directly injected into the engine cylinder, that is, the fuel is injected to form a rich mixture around a spark plug (not shown) and a lean mixture in the remaining space with respect to an air-fuel mixture distribution. Because the mixture distribution in the cylinder should be optimumly controlled for the stratified combustion, it is required to provide injection hole 24 with the predetermined angle against the longitudinal axis of the injector 10 and to determine the position of the injector 10 with respect to the rotating direction of the injector 10 so that the fuel spray from the injection hole 24 may be directed in the predetermined direction in the cylinder.

A movable core 30 is fixed by laser welding or the like to the needle valve 23 at its lower end. A stationary core 31 is placed inside the housing 11 to face the movable core 30 in the axial or longitudinal direction and has an air gap 36 against the stationary core 30. The stationary core 31 is fixed by laser welding or the like to the housing 11 at the top end of the housing 11. A spring 32 biases the movable core 30 to normally close the injection hole 24 by the needle valve 23. The biasing force of the spring 32 is adjusted by adjusting the axial position of an adjusting pipe 33 when the injector 10 is assembled. An exciting coil 34 is wound around a spool 35 and is disposed radially between the housing 11 and the stationary core 31.

When the coil 34 is kept deenergized, the needle valve 23 is biased by the spring 32 to seat on the valve seat 20*a* and close the injection hole 24 so than no fuel is injected from the injection hole 24. When the coil 34 is energized, the movable core 30 is attracted toward the stationary core 31 against the biasing force of the spring 32 by the attraction force in the air gap 36 caused by the magnetic force generated by the coil 34. The needle valve 23 lifts with the movable core 30 at this time and leaves from the valve seat 20*a* so that fuel is injected from the injection hole 24.

A connector 41 is resin-molded with the housing 11 and the stationary core 31. A power receiving pin 42 housed in the connector 41 is electrically connected to the coil 34 to supply electric power to the coil 34.

A pipe connector 51 connected to a fuel pipe 50 is pressed to the fuel inlet opening of the stationary core 31 by a retaining nut 52. The fuel flowing from the pipe 50 is subjected to filtering out foreign matters by a filter 43 and introduced into the injector 10.

The stopper 40 is formed annularly and fixed to the stationary core 31 by welding, brazing or the like. The stopper 40 may be formed integrally with the stationary core 31. A protrusion 40*a* extending radially is formed on the stopper 40 at a predetermined circumferential position of the stopper 40 so that it may be fitted into a positioning groove 3*a* extending longitudinally in the cylinder head 1.

A protrusion 3 is formed on an uppermost part of the cylinder head 1 to be higher than the part where the mounting hole 2 for the injector 10 is drilled. The positioning groove 3*a* is formed on the side wall of the protrusion 3. The positioning groove 3*a* extends in parallel with the longitudinal direction of the injector 10, that is, in the injector mounting direction. The position of the injector 10 in the rotating direction is determined by inserting the protrusion 40*a* in the positioning groove 3*a*, thus determining the direction of fuel injection from the injection hole 24.

The cylinder screw 60 is shaped cylindrically. A male thread 60*a* formed on its outer periphery wall is thread-engaged with a female thread 2*a* formed on the inner peripheral wall of the mounting hole 2. A tapered surface 60*b* is formed on the cylinder screw 60 at the top axial end opposite to the side of injection hole 24 in such a manner that its inner diameter increases in the upward direction in FIG. 1, that is, as it is farther from the injection hole 24. Under the condition that the cylinder screw 60 is fitted around the outer periphery of the injector 10 before the injector 10 is attached to the cylinder head 1, the cylinder screw 60 is held axially movably between the tapered surface 11*b* and the flange 22*c*.

When thread-engaged with the cylinder head 1 for mounting the injector 10 in the mounting hole 2, the cylinder screw 60 presses the flange 22*c* in the longitudinal direction of injector 10, leaving a spacing between the tapered surfaces 11*b* and 60*b*. When the thread-engagement with the cylinder head 1 is loosened for detaching the injector 10 from the mounting hole 2, on the other hand, the tapered surface 60*b* presses the tapered surface 11*b* in a direction opposite to the injector mounting direction leaving a space between the bottom axial end of the cylinder screw 60 and the annular flange 22*c*. That is, the cylinder screw 60 abuts the flange 22*c* or the tapered surface 60*b* at its both axial ends which are opposite in position in the axial direction of the injector 10.

A washer 61 is placed on a stepped part 2*b* of the mounting hole 2. When the cylinder screw 60 is thread-engaged with the cylinder head 1, the flange 22*c* of the retaining nut 22 is pressed onto the washer 61 by the tightening force of the cylinder screw 60.

The injector 10 is attached to and detached from the cylinder head in the following manner.

1. Attachment of injector 10:

(1) The washer 61 is placed on the stepped part 2*b* of the mounting hole 2 of the cylinder head 1. The injector 10 with the cylinder screw 60 being movably fitted therearound is inserted in the longitudinal direction into the mounting hole 2 while guiding the protrusion 40*a* of the stopper 40 by the positioning groove 3*a*. When the cylinder screw 60 has not been tightened to the cylinder head 1, the flange 22*c* of the retaining nut 22 does not abut the washer 61.

(2) When the cylinder screw 60 is turned in the direction of thread-engagement with the cylinder head 1, the cylinder screw 60 abuts and presses down the top surface of the flange 22*c*. Thus, the injector 10 is inserted into the mounting hole 2 together with the cylinder screw 60 until the flange 22*c* abuts the washer 61. The injector 10 moves only in the longitudinal direction because turning is restricted by the engagement between the protrusion 40*a* and the positioning groove 3*a*.

(3) When the cylinder screw 60 is tightened further, the end of the bottom end of the cylinder screw 60 tightly abuts the flange 22*c*, pressing the injector 10 to the cylinder head 1 firmly as shown in FIG. 1.

2. Detachment of injector 10:

(1) As the thread-engagement is loosened from the condition shown in FIG. 1 by turning the cylinder screw 60 in a direction reverse to the direction of thread-engagement with the cylinder head 1, only the cylinder screw 60 is moved upward releasing the abutment of its bottom surface from the top surface of the flange 22*c*. The tapered surface 60*b* of the cylinder screw 60 then comes into abutment with the tapered surface 11*b* of the housing 11.

(2) When the cylinder screw 60 is turned further in the direction to loosen the thread-engagement, the cylinder screw 60 now presses the tapered surface 11*b* of the housing 11 upward. Thus, the injector 10 is lifted upward in FIG. 1, that is, in a direction the injector 10 is detached from the cylinder head 1, while keeping the tapered surface 60*b* in abutment with the tapered surface 11*b*.

(3) When the cylinder screw 60 is turned further in the direction of loosening the thread-engagement, the thread-engagement between the cylinder head 1 and the cylinder screw 60 is released so that the injector 10 may be detached from the cylinder head 1.

According to the above first embodiment, the cylinder screw 60 is capable of abutting the injector 10 at both ends in the direction of attaching the injector 10 to the cylinder head 1 and in the direction of detaching the injector 10 from the cylinder head 1. The injector 10 can be attached to and detached from the cylinder head 1 by the use of one cylinder screw 60.

As the injector 10 can be lifted axially in the detaching direction, the injector 10 can be detached from the cylinder head 1 with ease without damaging the injector 10 and the cylinder head 1 even under the condition that soot or a similar substance is sticking between the nozzle part of the injector 10 and the cylinder head 1. Therefore, the injection characteristics of the injector 10 thus detached can be maintained so that the injector 10 may be reused.

Second Embodiment

Figure 2:
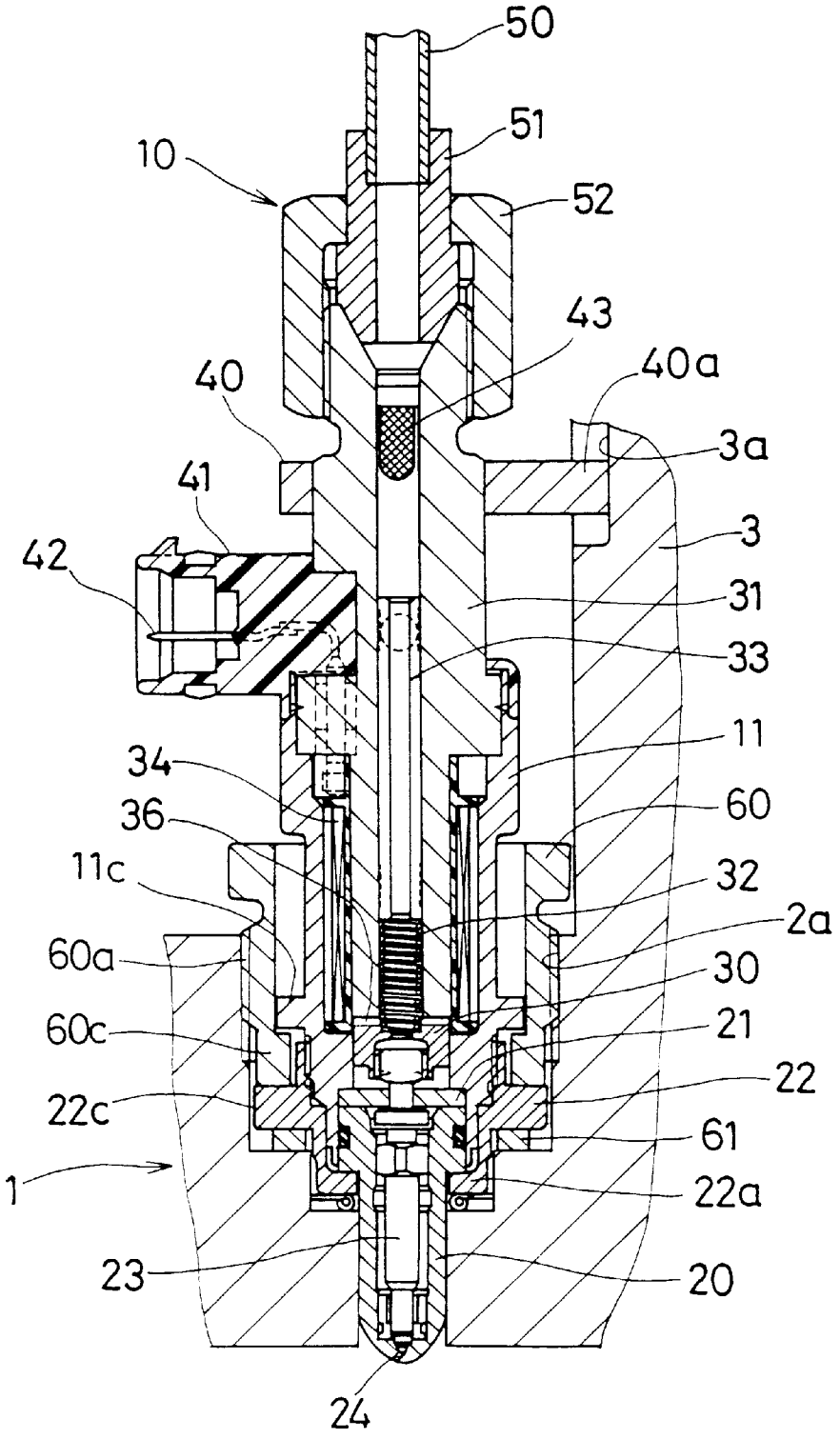
FIG. 2 is a longitudinal sectional view of a fuel injection apparatus according to the second embodiment of the present invention.

In the second embodiment shown in FIG. 2, the thread-engagement part between the retaining nut 22 and the housing 11 is made shorter than in the first embodiment. An annular flange 11*c* which protrudes radially outwardly and functions as the second engagement part is provided on the outer periphery of the housing 11. The flange 11*c* is near the end of the thread-engagement part and opposite to the injection hole 24. The flange 11*c* as the second engagement part is located radially at substantially the same elevation as the bottom end of the stationary core 31 (air gap between the cores 30 and 31) so that it is located more closely to the injection hole 24 than the tapered surface 11*b* as the second engagement part of the first embodiment.

The male thread 60*a* is provided around the outer peripheral wall of the cylinder screw 60 for thread-engagement with the female thread 2*a* of the mounting hole 2. The cylinder screw 60 is formed with a small diameter part 60*c* at the lowermost part which is close to the injection hole 24. The inner diameter of small diameter part 60*c* is smaller than the flanges 22*c* and 11*c*. The axial length of the small diameter part 60*c* is shorter than the axial distance between the flanges 11*c* and 22*c*. Thus, the cylinder screw 60 is fitted axially movably between the flanges 22*c* and 11*c* under the condition the injector 10 is not mounted on the cylinder head 1.

According to the second embodiment, because the flange 11*c* as the second engagement part is provided at a position close to the injection hole 24 as described above, the flange 11*c* as well as the flange 22*c* are located within the cylinder head 1 under the condition the injector 10 is attached to the cylinder head 1 as shown in FIG. 2. Accordingly, even in the case that a large force is applied from the cylinder screw 60 to the flange 11*c* to detach the injector 10 from the cylinder head 1 against sticking of soot and similar substance between the nozzle part of the injector 10 and the cylinder head 1, the deformation which may be caused in the injector 10 will be reduced to less than in the first embodiment owing to the shortened distance between the soot-stuck part and the flange. As most of the members which constitute a magnetic circuit of the injector 10 as well as the adjusting pipe 33 which determines the biasing force of the spring 32 are not located between the soot-stuck part and the flange 11, the air gap between the cores 30 and 31 as well as the biasing force of the spring 32 will change less. As a result, the injection characteristics of the injector 10 will not be altered much and hence the injector 10 may be reused after being detached.

Third Embodiment

Figure 3:
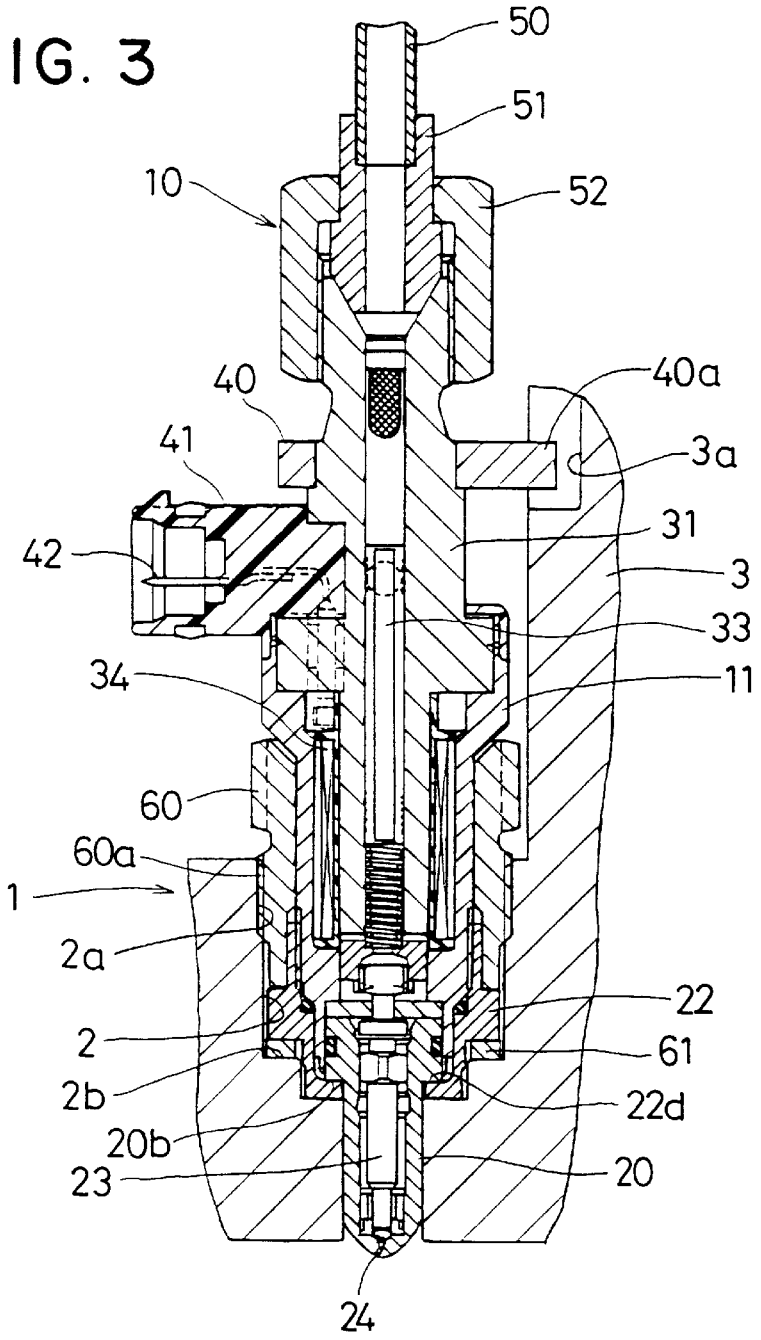
FIG. 3 is a longitudinal sectional view of a fuel injection apparatus according to the third embodiment of the present invention.
Figure 4:
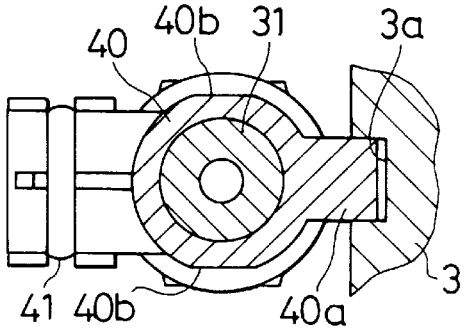
FIG. 4 is a transverse sectional view of the third embodiment including a stopper.

The third embodiment shown in FIGS. 3 and 4 is similar to the first embodiment shown in FIG. 1. In this embodiment, the housing 11 and the nozzle body 20 are coupled in the injector 10 as follows. The nozzle body 20 is inserted turnably within the retaining nut 22 and the housing 11. An axial bottom end surface 20*b* of the nozzle body 20 is held in abutment with an upper end surface 22*d* of the retaining nut 22, preferably through an annular ring (not shown). The retaining nut 22 is thread-engaged with the housing 11 as in the first embodiment.

As shown in FIG. 4, the stopper 40 which functions as a rotation restricting member is shaped annularly and fixed to the stationary core 30 by welding, brazing or the like. The stopper 40 may be made integrally with the stationary core 30. The protrusion 40*a* which is inserted into the positioning groove 3*a* as a recess part is provided at a predetermined circumferential position. Two cuts 40*b* are formed on the stopper 40 at both sides which crosses perpendicularly to the direction of the protrusion 40*a* of the stopper 40 so that the injector 10 may be held with ease by gripping the cuts 40*b*.

1. Attachment of injector 10:

When the cylinder screw 60 is tightened, tilting of the injector 10 may be prevented by gripping the cuts 40*b* of the stopper 40 by an appropriate tool. In this instance, because the protrusion 40*a* is engaged in the groove 3*a* and restricted from turning in the direction of tightening the injector 10, it is only required that the injector 10 be held in position by the tool to the extent that the injector 10 does not tilt. Thus, injector mounting operation can be simplified. While tightening the cylinder screw 60, the protrusion 40*a* is restricted by the positioning groove 3*a* from turning in the rotating direction.

As the cylinder screw 60 is thread-engaged with the cylinder head 1 and the injector 10 is pressed to the cylinder head 1 by the tightening force of the cylinder screw 60, the tightening force of the cylinder screw 60 applied in the rotating direction does not exert force directly onto the injector 10. With a thin annular ring (not shown) being inserted as a sliding member in the abutment part between the cylinder screw 60 and the retaining nut 22, the cylinder screw 60 will slide on the thin annular ring even when the cylinder screw 60 is tightened under abutment with the retaining nut 22. As a result, the rotating force of the cylinder screw 60 will not be exerted directly onto the retaining nut 22, that is, onto the injector 10.

As described above, when the injector 10 is attached to the cylinder head 1 by the cylinder screw 60, the thread-engaging force in the rotating direction will not exert force directly onto the abutment part between the cylinder screw 60 and the retaining nut 22 and the abutment part between the protrusion 4*a* and the positioning groove 3*a*. Therefore, the twisting force, which will be exerted on the magnetic circuit members of the injector 10, the adjusting pipe 33 as an injection quantity adjusting member for adjusting the biasing force of the spring biasing the valve member and the like all being housed between the above two abutment parts, will be minimized. Thus, the injection characteristics of the injector 10, that is, injection timing and injection quantity of the injector 10, can be maintained without being not altered by changes in the air gap between the cores 30 and 31 and biasing force on the valve member, by degradation of sliding characteristics of the movable members, or degradation of fixing strength at the fixed parts between members in the injector 10.

2. Attachment of fuel pipe 50:

The fuel pipe 50 is connected to the injector 10 after mounting the injector 10 on the cylinder head 1. The pipe connector 51 is fixed to the end of the fuel pipe 50. The pipe connector 51 and the injector 10 are connected by thread-engaging the retaining nut 52 with the injector 10. Because the retaining nut 52 and the injector 10 are in direct thread-engagement with each other, the tightening force in the rotation direction of the retaining nut 52 is exerted directly onto the injector 10 as the thread-engagement proceeds.

However, with the protrusion 40*a* being restricted from turning by the positioning groove 3*a*, the tightening force of the retaining nut 52 in the rotation direction is not exerted on the injector 10 which is mostly at the injection hole side from the stopper 40. Therefore, the twisting force is not exerted on the magnetic circuit members, adjusting pipe 33 and the like which are housed within the injector 10 existing at the injection hole side from the stopper 40. Thus, the injection characteristics of the injector 10, that is, injection timing and injection quantity of the injector 10, can be maintained without being not altered by changes in the air gap and biasing force on the valve member, by degradation of sliding characteristics of the movable members, or degradation of fixing strength at the fixed parts between members in the injector 10.

3. Detachment of fuel pipe 50 and injector 10:

In each case of detaching the fuel pipe 50 from the injector 10 and detaching the injector 10 from the cylinder head 1, the protrusion 40*a* is restricted by the recess 3*a* from turning in the direction opposite to the direction of rotation at the time of mounting the injector 10 and connecting the fuel pipe 50 so that the injector 10 is also restricted from turning as well. Thus, detaching work will be attained with ease as in the mounting work.

As in the case of mounting the injector 10 and connecting the fuel pipe 50, the twisting force is not exerted on the magnetic circuit constituting members, adjusting pipe 33 and the like which are housed within the injector 10. Thus, the injection characteristics of the injector 10, that is, injection timing and injection quantity of the injector 10, can be maintained without being altered by changes in the air gap and biasing force on the valve member, by degradation of sliding characteristics of the movable members, or degradation of fixing strength at the fixed parts between members in the injector 10. As a result, the injector 10 thus detached can be reused.

Although the protrusion 40*a* is engaged with the positioning groove 3*a* in both rotating directions of the injector 10 in this embodiment, the protrusion 40*a* may be engaged with the groove 3*a* only in the tightening direction of the cylinder screw 60 and the retaining nut 52.

Further, although the injector 10 is restricted from rotating by providing the protrusion 40*a* on the injector 10 and the recess 3*a* in the cylinder head 1 in this embodiment, the recess 3*a* and the protrusion 40*a* may be provided in the injector 10 and on the cylinder head 1, respectively.

Still further, the injector 10 is detached from the cylinder head 1 by loosening the thread-engagement between the cylinder screw 60 and the cylinder head 1 and thereby pressing the housing 11 upwardly in this embodiment, it may be so modified that only the cylinder screw 60 is detached from the cylinder head 1 at the time of loosening the thread-engagement between the cylinder screw 60 and the cylinder head 1. In this instance, the injector 10 may be detached from the cylinder head 1 by gripping and pulling out the injector 10 by an appropriate tool.

Moreover, although the injector 10 is attached to the cylinder head 1 by the tightening force of the cylinder screw 60 for the thread-engagement with the cylinder head 1, it is also possible to mount the injector 10 in the cylinder head 1 by fixedly engaging a cylindrical member fitted on the injector 10 with the injector 10 and pressing the cylindrical member in the mounting direction to the cylinder head 1 by the use of an appropriate tool.

Fourth Embodiment

Figure 5:
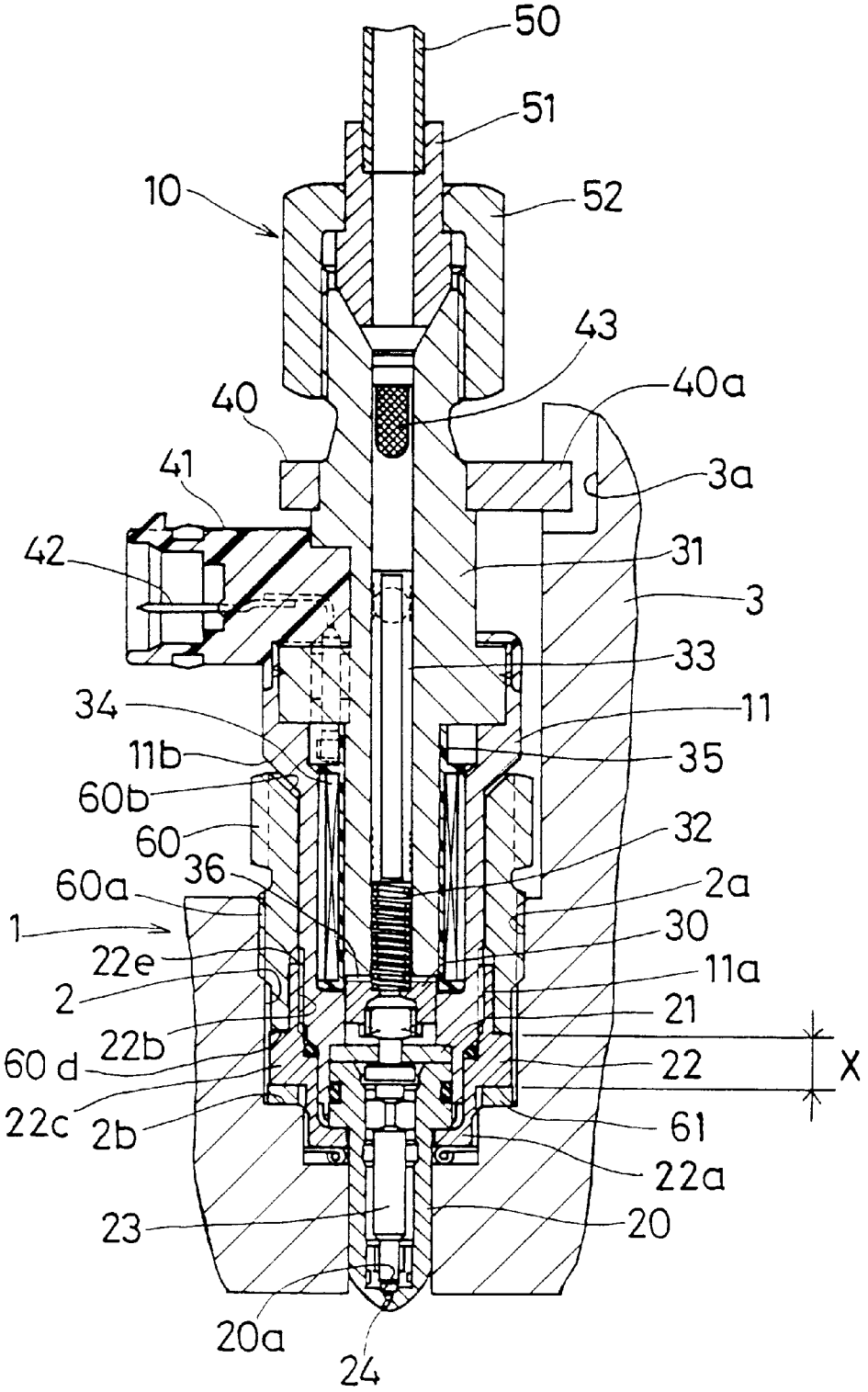
FIG. 5 is a longitudinal sectional view of a fuel injection apparatus according to the fourth embodiment of the present invention.

The fourth embodiment shown in FIG. 5 is also similar to the first embodiment shown in FIG. 1. In this embodiment, the flange 22*c* abuts the cylinder screw 60 at an axial lower end 60*d* of the thread-engagement part between the housing 11 and the retaining nut 22. This end 60*d* is on the side in the mounting direction of the injector 10 and is opposite to an axial upper end 22*e* of the thread-engagement part in the injector mounting direction. This position is distanced from the air gap 36 provided between the movable core 30 and the stationary core 31 in the injector mounting direction.

Figure 6:
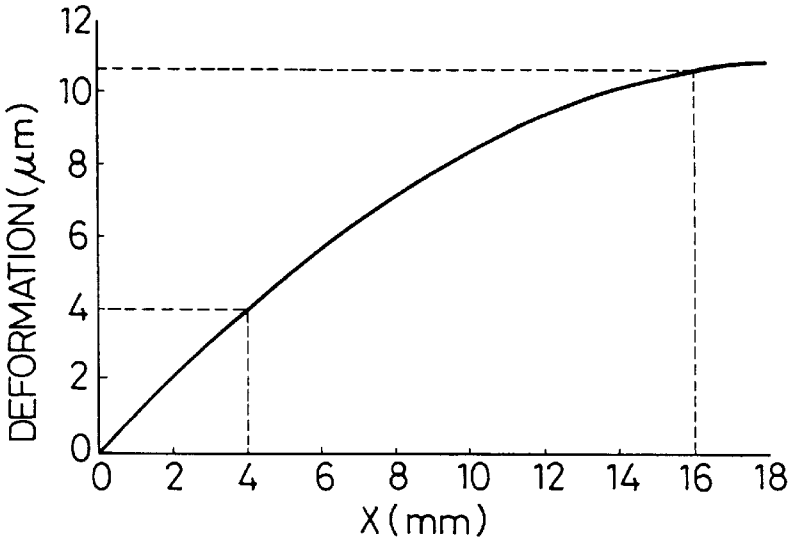
FIG. 6 is a characteristic chart illustrating a difference between deformations in the fourth embodiment and a comparative example.

The deformation which may occur in the injector 10 by the tightening force of the cylinder screw 60 will become larger as the axial length to which the tightening force is applied becomes longer. Assuming a comparative example (axial length is 16 mm) in which the retaining nut 22 has the substantially the same outer diameter up to its end which is opposite in the injector mounting direction and the cylinder screw 60 abuts this end of the retaining nut 22 located oppositely in the injector mounting direction, the axial length to which the tightening force is applied is much longer than in the present embodiment in which the axial length is 4 mm. As shown in FIG. 6 in which the amount of deformation of the flange relative to the thickness X of the flange under the tightening force of 1500 kg is illustrated, the amount of deformation in the thickness of the flange 22*c* increases with the thickness. As the deformation in the injector increases, the magnetic circuit members in the injector 10 such as the stationary core 31 and movable core 30 may deform resulting in shortening of the air gap 36. Further, the biasing force of the spring 32 which biases the movable core 32 may be changed also due to the deformation of the members. It may also occur that the sliding characteristics of the movable part in the injector 10 degrade or the fixing strength between the members is weakened.

If the fuel injection characteristics of the injector 10, that is, the fuel injection quantity and fuel injection timing of the injector 10, change due to deformation in the injector members at the time of attaching the injector, the injector performance expected at the time of manufacturing can not be provided. According to this embodiment, however, because the axial length to which the tightening force of the cylinder screw 60 is applied is shortened, the deformation of the members in the injector 10 is reduced as shown in FIG. 6 so that changes in the fuel injection characteristics may be reduced. Further, because the position where the tightening force of the cylinder screw 60 exerts is on the side of the air gap 36 in the injector mounting direction, the shortening of the air gap 36 is reduced to a possible minimum.

Fifth Embodiment

Figure 7:
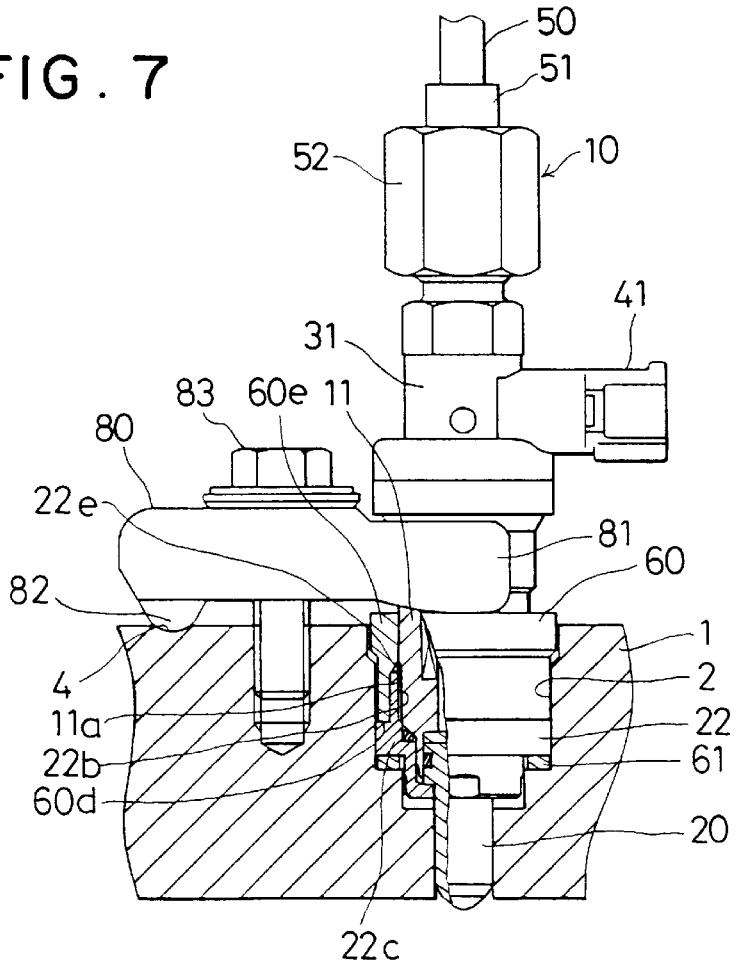
FIG. 7 is a side view of a fuel injection apparatus according to the fifth embodiment of the present invention.

In the fifth embodiment shown in FIG. 7, the cylinder screw 60 and the mounting hole 2 have no threads on the respective outer peripheral wall and the inner peripheral wall. Under the condition that the injector 10 fitted with the cylinder screw 60 is mounted in the mounting hole 2, the injector 10 is not fixedly engaged in the cylinder head 1 but held reciprocably movably. The cylinder screw 60 abuts the flange 22*c* of the retaining nut 22, at the axial end 60*d* located at the side of the thread-engagement part between the housing 11 and the retaining nut 22 in the injector mounting direction than the side of the same part in the direction opposite to the injector mounting direction, to press the flange 22*c* toward the washer 61 in the same manner as in the foregoing embodiments. A pressing member 80 has a pair of arms 81 which abut the top surface of the end 60*e* of the cylinder screw 60. The housing 11 is formed with a pair of recesses on radial sides of its outer peripheral wall. The arms 81 abut those recesses from both sides to determine the position of the injector 10 in its rotating direction. The arms 81 are formed with respective protrusions 82 at the connecting part therebetween. The protrusions 82 fit in recesses 4 formed on the surface of the cylinder head 1.

The injector 10 fitted in the cylinder screw 60 is inserted into the mounting hole 2. The protrusion 82 is then fitted in the recess 4 while restricting the rotational position of the injector 10 by the arms 81 of the pressing member 80. Finally, a bolt 83 is threaded into the cylinder head 1 so that the arms 81, with its protrusion 82 functioning as a fulcrum, presses the cylinder screw 60 in the injector mounting direction thus attaching the injector 10 to the cylinder head 1.

The injector 10 can be detached from the cylinder head 1, once the bolt 83 is loosened to disengage the pressing member 80 from the injector 10.

According to this embodiment, no thread is necessitated on the mounting hole 2 which is machined in correspondence with the end shape of the injector 10. Therefore, machining the cylinder head is simplified.

The foregoing embodiments may be altered or modified further in many ways without departing from the spirit of the present invention.

What is claimed is:

1. A fuel injection apparatus for injecting fuel into an engine when mounted in a mounting hole on a cylinder head, the apparatus comprising:

an injector having a first engagement part and a second engagement part located axially oppositely and extending radially outwardly; and a mounting member fitted around an outer periphery of the injection and movably between the first and second engagement parts for attaching the injector to the cylinder head through a thread-engagement with the cylinder head, the mounting member being constructed to abut and press the first engagement part in a direction the injector is attached to the cylinder head through the thread-engagement with the cylinder head, and the mounting member being constructed to abut and press the second engagement part in an opposite direction when the thread-engagement with the cylinder head is loosened to detach the injector from the cylinder head, wherein a distance between the first and second engagement parts is shorter than a length of the mounting member.

2. A fuel injection apparatus as in claim 1 wherein the first engagement part and the second engagement part are located axially within the mounting hole of the cylinder head under the condition the injector is attached to the cylinder head.

3. A fuel injection apparatus for injecting fuel into an engine when mounted in a mounting hole on a cylinder head, the apparatus comprising:

an injector having a first engagement part and a second engagement part located axially oppositely; and a mounting member fitted around an outer periphery of the injector for attaching the injector to the cylinder head through a thread-engagement with the cylinder head, the mounting member being constructed to about and press the first engagement part in a direction the injector is attached to the cylinder head through the thread-engagement with the cylinder head, and the mounting member being constructed to about and press the second engagement part in an opposite direction when the thread-engagement with the cylinder head is loosened to detach the injector from the cylinder head;

wherein the injector is an electromagnetic type including a movable core and a stationary core with an air gap therebetween; and the second engagement part is located at substantially the same elevation as the air gap at radially outside the air gap.

4. A fuel injector apparatus as in claim 1 wherein the mounting member is fitted around the injector axially and circumferentially movably between the first engagement part and the second engagement part.

5. The apparatus according to claim 4, wherein:

the second engagement part is formed with a tapered surface; and the mounting member is formed with a tapered surface which faces the tapered surface of the second engagement part.

6. A fuel injection apparatus for injecting fuel into an engine when mounted in a mounting hole on a cylinder head, the apparatus comprising:

an injector having a rotation restricting member engageable with the cylinder head to restrict a rotation in at least one rotating direction; and a mounting member for attaching the injector to the cylinder head axially while keeping the rotation restricting member in engagement with the cylinder head;

wherein the rotation restricting member has a protrusion engageable with a recess provided in the cylinder head to restrict the rotation in the one rotating direction.

7. A fuel injection apparatus for injecting fuel into an engine when mounted in a mounting hole on a cylinder head, the apparatus comprising:

an injector having a rotation restricting member engageable with the cylinder head to restrict a rotation in at least one rotating direction;

a mounting member for attaching the injector to the cylinder head axially while keeping the rotation restricting member in engagement with the cylinder head;

a fuel pipe; and a connecting member thread-engageable with the injector at an end of the injector for connecting the fuel pipe to the injector, the connecting member being disabled by the rotation restricting member to turn the injector when threaded along the injector.

8. The apparatus according to claim 7, wherein:

the injector includes a thread-engageable part for a thread-engagement with the connecting member, a magnetic circuit member and an injection quantity metering member; and the rotation restricting member is positioned between the thread-engageable part and at least one of the magnetic circuit member and the injection quantity metering member.

9. A fuel injection apparatus for injecting fuel into an engine when mounted in a mounting hole on a cylinder head, the apparatus comprising:

an injector having a rotation restricting member engageable with the cylinder head to restrict a rotation in at least one rotating direction; and a mounting member for attaching the injector to the cylinder head axially while keeping the rotation restricting member in engagement with the cylinder head;

wherein the mounting member has a cylinder screw fitted around the injector and threadable into the cylinder head, the cylinder screw being constructed to press the injector to the cylinder head when threaded into the cylinder head to mount the injector in the cylinder head.

10. A fuel injection apparatus for injecting fuel into an engine when mounted in a mounting hole on a cylinder head, the apparatus comprising:

an injector having a nozzle body provided with an injection hole at an end thereof and a housing located oppositely to the injection hole of the nozzle body;

a retaining member engaged with the housing to retain the nozzle body to the housing;

a mounting member fitted around the injector and abutting axially the retaining member at an end of an engagement part between the retaining member and the housing, the end of the engagement part being located closer to the injection hole than another end of the engagement part; and a pressing member pressing the mounting member in a direction of mounting the injector thereby to mount the injector to the cylinder head;

wherein the retaining member includes a flange extending radially outwardly and having a surface which is abutted by the mounting member at a side opposite to the injection hole.

11. The apparatus according to claim 10, wherein:

the pressing member includes a thread between the cylindrical member and the cylinder head.

12. The apparatus according to claim 10, wherein:

the pressing member includes a member abutting the mounting member at a location outside of the cylinder head and a member pressing the abutting member in the direction of mounting the injector thereby to mount the injector to the cylinder head.

13. The apparatus according to claim 10, wherein:

the injector includes a retaining nut which provides the first engagement part and is threaded at a position close to an injection hole of the injector.

14. The apparatus according to claim 10, wherein:

the second engagement part is provided at substantially radially outside position of an electromagnetically-actuated movable core of the injector.

* * * * *

UNITED STATES PATENT AND TRADEMARK OFFICE

CERTIFICATE OF CORRECTION

PATENT NO. : 5,943,995
DATED : August 31, 1999
INVENTOR(S) : NIWA et al

It is certified that error appears in the above-identified patent and that said Letters Patent is hereby corrected as shown below:

On the title page item [73], should read:

Denso Corporation, Kariya, Japan and Toyota Jidosha Kabushiki Kaisha, Toyota-shi, Aichi-ken, Japan Signed and Sealed this Twenty-sixth Day of September, 2000

*Attest:*

Q. TODD DICKINSON

*Attesting Officer*

*Director of Patents and Trademarks*